US006988655B1

(12) United States Patent
Riccio

(10) Patent No.: US 6,988,655 B1
(45) Date of Patent: Jan. 24, 2006

(54) TELESCOPIC MAILBOX SUPPORT DEVICE

(76) Inventor: Anthony E. Riccio, 18 Dauntless La., Plaistow, NH (US) 03865

( * ) Notice: Subject to any disclaimer, the term of this patent is extended or adjusted under 35 U.S.C. 154(b) by 0 days.

(21) Appl. No.: 10/877,432

(22) Filed: Jun. 28, 2004

(51) Int. Cl.
*B65D 91/00* (2006.01)

(52) U.S. Cl. ..... 232/39; 248/128; 248/424; 248/429

(58) Field of Classification Search ..... 232/39, 232/17; 248/128, 429, 121, 424, 145.6; D99/32
See application file for complete search history.

(56) References Cited

U.S. PATENT DOCUMENTS 1,584,085 A * 5/1926 England ..... 248/145
1,731,682 A * 10/1929 Pendergrass ..... 248/128
2,279,622 A * 4/1942 Hurd ..... 248/145
3,289,988 A * 12/1966 McKenney et al. ..... 248/145
3,465,994 A * 9/1969 Block ..... 248/130
3,497,078 A * 2/1970 Nash ..... 211/79
4,300,739 A * 11/1981 Sande ..... 248/219.4
4,480,403 A * 11/1984 Williams ..... 47/42
4,484,705 A 11/1984 Sande
4,496,123 A * 1/1985 Laramie ..... 248/121
4,821,952 A * 4/1989 Deciutiis ..... 232/17
4,995,576 A * 2/1991 Kieswetter ..... 248/145
D371,884 S 7/1996 Esgro
5,713,514 A 2/1998 Eck
5,941,455 A 8/1999 Cutugno
6,161,756 A 12/2000 Upton
6,164,527 A 12/2000 Garey
6,543,680 B1 4/2003 McCormack

* cited by examiner

*Primary Examiner*—William L. Miller

(57) ABSTRACT

The device includes an elongated shaft disposed along a vertical plane, a bracket being adaptable to selected shapes for being secured to the shaft, and a telescopic support member extending outwardly from the bracket along a substantially orthogonal path. The telescopic support member includes a plurality of elongated tubes slidably engageable along a path for moving a mailbox between extended and retracted positions. One of the tubes is secured to the bracket, wherein a plurality of stop members is selectively engageable with each other for defining a distance along which the plurality of tubes can be moved. The device further includes a platform secured to an inner tube for maintaining a mailbox thereon, and a handle is provided beneath the platform for assisting a user to move the support member between selected positions.

14 Claims, 5 Drawing Sheets

TELESCOPIC MAILBOX SUPPORT DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a mailbox extension device and, more particularly, to a telescopic mailbox support device for assisting a user to retrieve mail.

2. Prior Art

In rural areas, mailboxes are usually mounted on posts adjacent a roadway to allow a mail carrier to deliver mail from an automobile without having to exit the vehicle. A rural mailbox typically has a standardized design generally comprising an elongated metal box with a semi-cylindrical top and a hinged door at one end. The base of the box is recessed to create a skirt around the bottom perimeter of the box with screw holes for fastening the box to a support stand.

In the winter, roadway snow plowing frequently creates a snow buildup along the side of the road, making it difficult to gain access to the mailbox to either insert mail into or retrieve mail from the box. In this situation, it is desirable to be able to temporarily extend the mailbox closer to the roadway in order to facilitate ready access to the interior of the box by the mail carrier who may not deliver the mail if the box is not readily accessible. There are many examples in the prior art of devices intended to permit a post-mounted rural mailbox to be extended forwardly; i.e., toward the roadway from the post mount. However, the prior art devices tend to be mechanically complicated, subject to rust and corrosion, are incompatible with standard mailboxes and/or are difficult to assemble.

Accordingly, a need remains for a telescopic mailbox support device that is easy to use and install on all mailboxes, not prone to rusting, adjustable to various lengths, and provides ease of mind that the mail will continue to be delivered.

BRIEF SUMMARY OF THE INVENTION

In view of the foregoing background, it is therefore an object of the present invention to provide a telescopic mailbox support device. These and other objects, features, and advantages of the invention are provided by a telescopic mailbox support device that includes an elongated shaft provided with a vertically disposed longitudinal axis and opposed end portions disposed adjacent to a ground surface and spaced upwardly therefrom at a predetermined height, respectively.

The present invention further includes a bracket that has a base portion and a plurality of sidewalls integral therewith and extending orthogonally therefrom. The bracket preferably has a substantially U-shape for being adapted about the shaft having a conventional square cross-section. Such a bracket has a plurality of apertures spaced along the base portion and the plurality of sidewalls for respectively receiving a plurality of corresponding fastening members therethrough so that the bracket can advantageously be secured to one end portion of the elongated shaft.

The device also includes a telescopic support member extending substantially orthogonal therefrom. The telescopic support member includes a plurality of elongated tubes having substantially cylindrical shapes with varying diameters and sharing a common centrally disposed longitudinal axis. Select ones of the plurality of tubes are slidably engageable along a path substantially parallel to the axis for conveniently moving the support member between extended and retracted positions.

Advantageously, each tube has opposed end portions, selectively engageable with an adjacent tubes end portions. In particular, one end portion of a tube is secured to the base of the bracket wherein such a tube is stationary and disposed at a fixed position adjacent the shaft. The plurality of tubes further have a plurality of stop members integral therewith for defining an axial distance along which the select ones of the tubes can be extended and retracted respectively.

The device further includes a platform, preferably a substantially rectangular shape, which has front and rear portions secured to another one of the plurality of tubes and is disposed forwardly thereof respectively. The platform further has a substantially planar top surface for securely maintaining a mailbox thereon during operating conditions.

The present invention may further include a handle that has a generally staple shape and is disposed adjacent to the front portion of the platform. The handle can be grasped by a user for conveniently moving the support member between extended and retracted positions. Advantageously, the handle extends downwardly from the platform and terminates at a predetermined distance therebeneath so that a user can maintain contact with the platform while contemporaneously retrieving mail from the mailbox.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
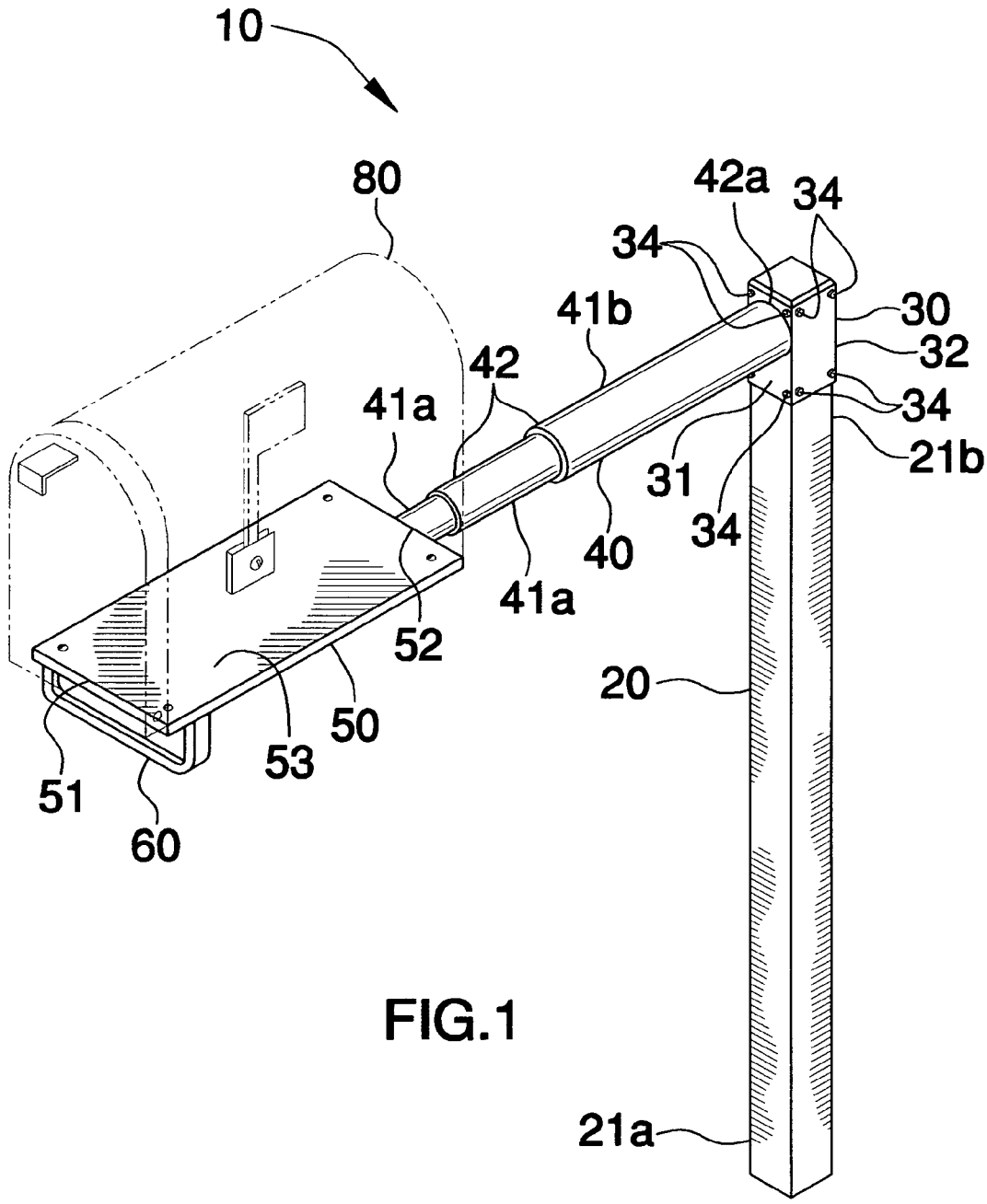
FIG. 1 is a perspective view showing a telescopic mailbox support device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–7 by the reference numeral 10 and is intended to provide a telescopic mailbox support device. It should be understood that the device 10 may be used to extend many different types of mailbox containers and should not be limited to extending only conventional mailboxes.

Referring initially to FIG. 1, the device 10 includes an elongated shaft 20 provided with a vertically disposed longitudinal axis and opposed end portions 21*a, b* disposed adjacent to a ground surface (not shown) and spaced upwardly therefrom at a predetermined height, respectively.

Figure 5:
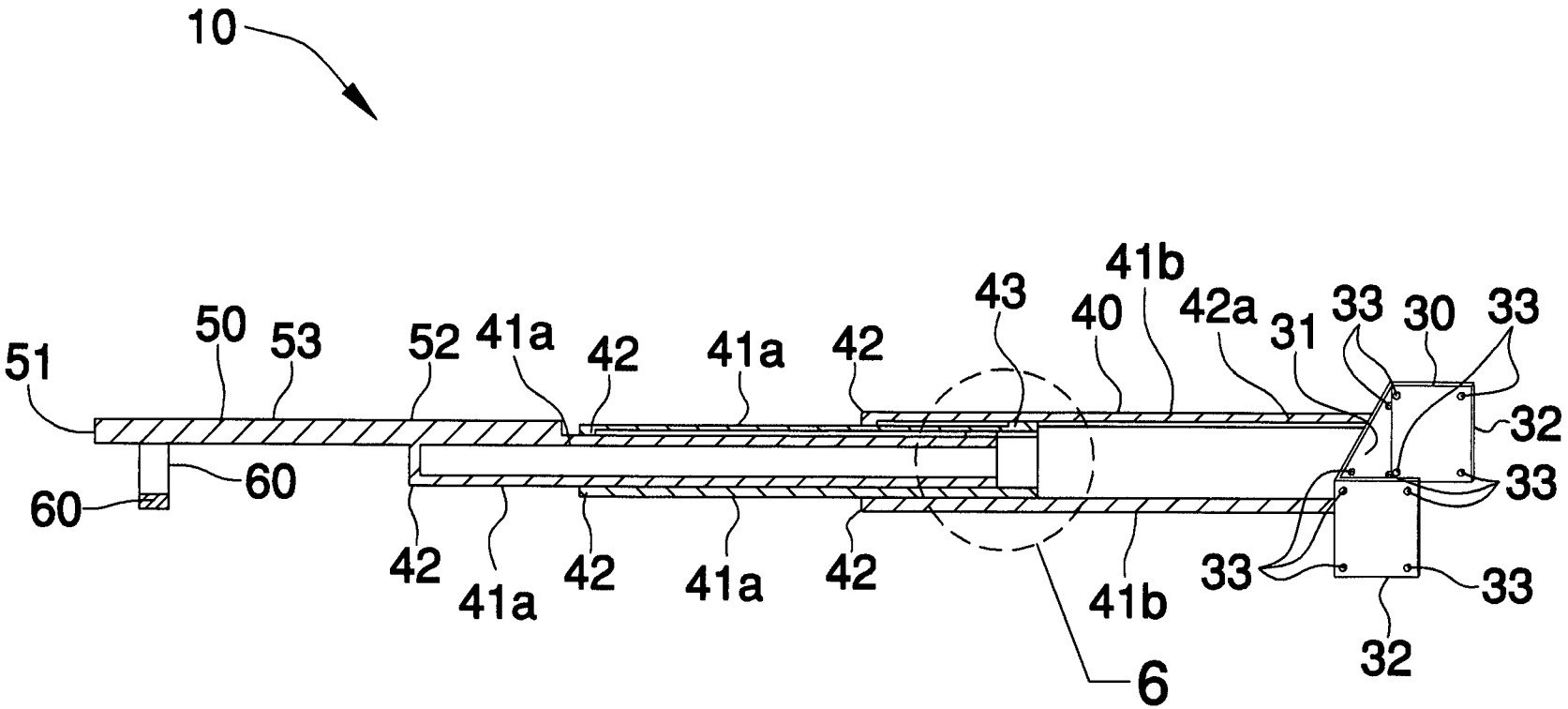
FIG. 5 is a cross-sectional view of the device shown in FIG. 3, taken along line 5—5.

The present invention further includes a bracket 30 that has a base portion 31 and a plurality of sidewalls 32 integral therewith and extending orthogonally therefrom. The bracket 30 has a substantially U-shape for being adapted about the shaft 20 having a conventional square cross-section. As is shown in FIG. 5, such a bracket 30 has a plurality of apertures 33 spaced along the base portion 31 and the plurality of sidewalls 32 for respectively receiving a plurality of corresponding fastening members 34 therethrough so that the bracket 30 can advantageously be secured to one end portion 21*b* of the elongated shaft 20. The bracket 30 advantageously prevents the device 10 from being pulled off of the shaft 20 during operating conditions, preventing possible injury to the user and damage to the device 10.

The device 10 also includes a telescopic support member 40 extending substantially orthogonal therefrom. The telescopic support member 40 includes a plurality of elongated tubes 41 having substantially cylindrical shapes with varying diameters and sharing a common centrally disposed longitudinal axis. Such elongated tubes 41 may be formed from polyvinylchloride (PVC) or other non-corrosive materials, as is well known in the industry, in order to ensure longevity of the device 10 in cold temperatures. Construction from PVC also advantageously prevents the elongated members 41 from sticking together and hindering the function of the device 10. Select ones of the plurality of tubes 41*a* are slidably engageable along a path substantially parallel to the axis for conveniently moving the support member 40 between extended and retracted positions. This feature allows the mailbox 80 to be effectively extended over, or through, any obstacles that might other wise prevent access to the mailbox 80, such as snow banks or hedges.

Figure 6:
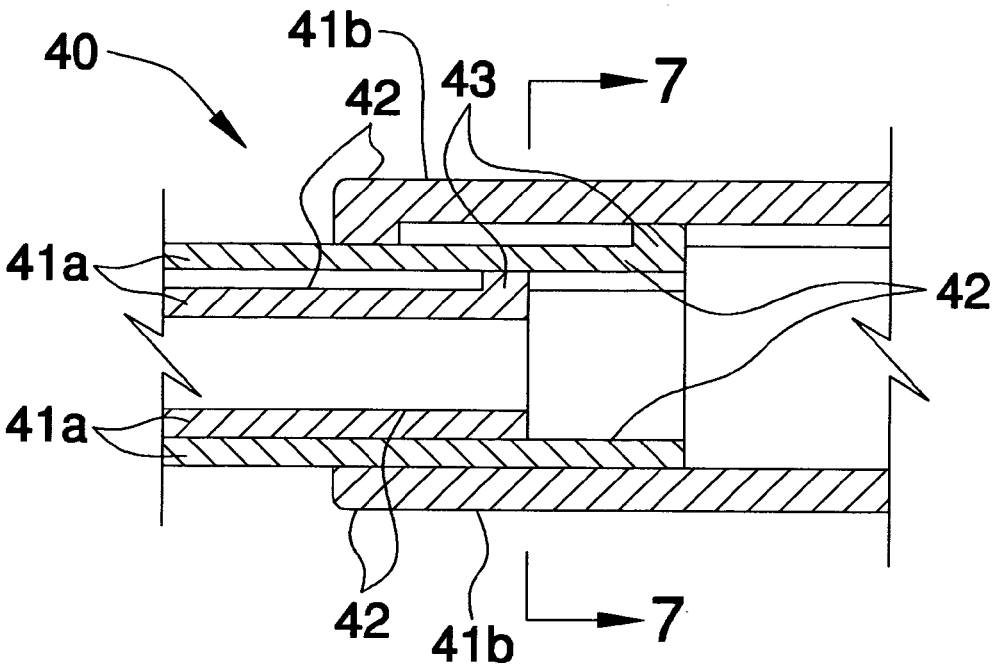
FIG. 6 is an enlarged cross-sectional view of the device shown in FIG. 5, taken along region 5.
Figure 7:
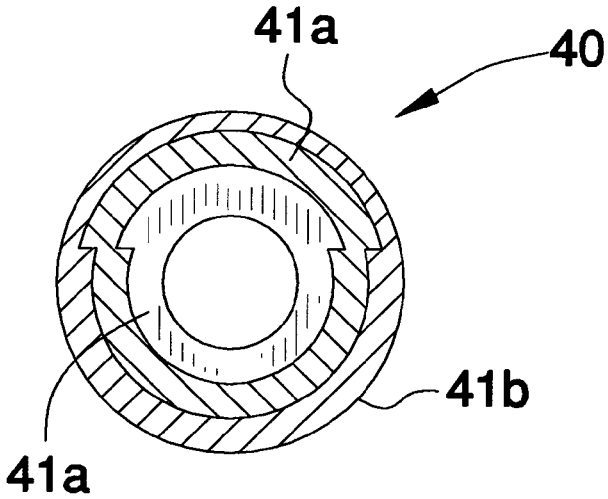
FIG. 7 is a cross-sectional view of the device shown in FIG. 6 showing the plurality of stop members of each tube, taken along line 7—7.

Advantageously, each tube 41 has opposed end portions 42, selectively engageable with an adjacent tube's 41 end portions 42. In particular, one end portion 42*a* of a tube 41*b* is secured to the base 31 of the bracket 30 wherein such a tube 41*b* is stationary and disposed at a fixed position adjacent the shaft 20. As illustrated in FIGS. 5 and 6, the plurality of tubes 41*a* further have a plurality of stop members 43 integral therewith for defining an axial distance along which the select ones of the tubes 41*a* can be extended and retracted respectively. The stop members 43 conveniently prevent an individual from disengaging the elongated tubes 41.

Figures 2, 3:
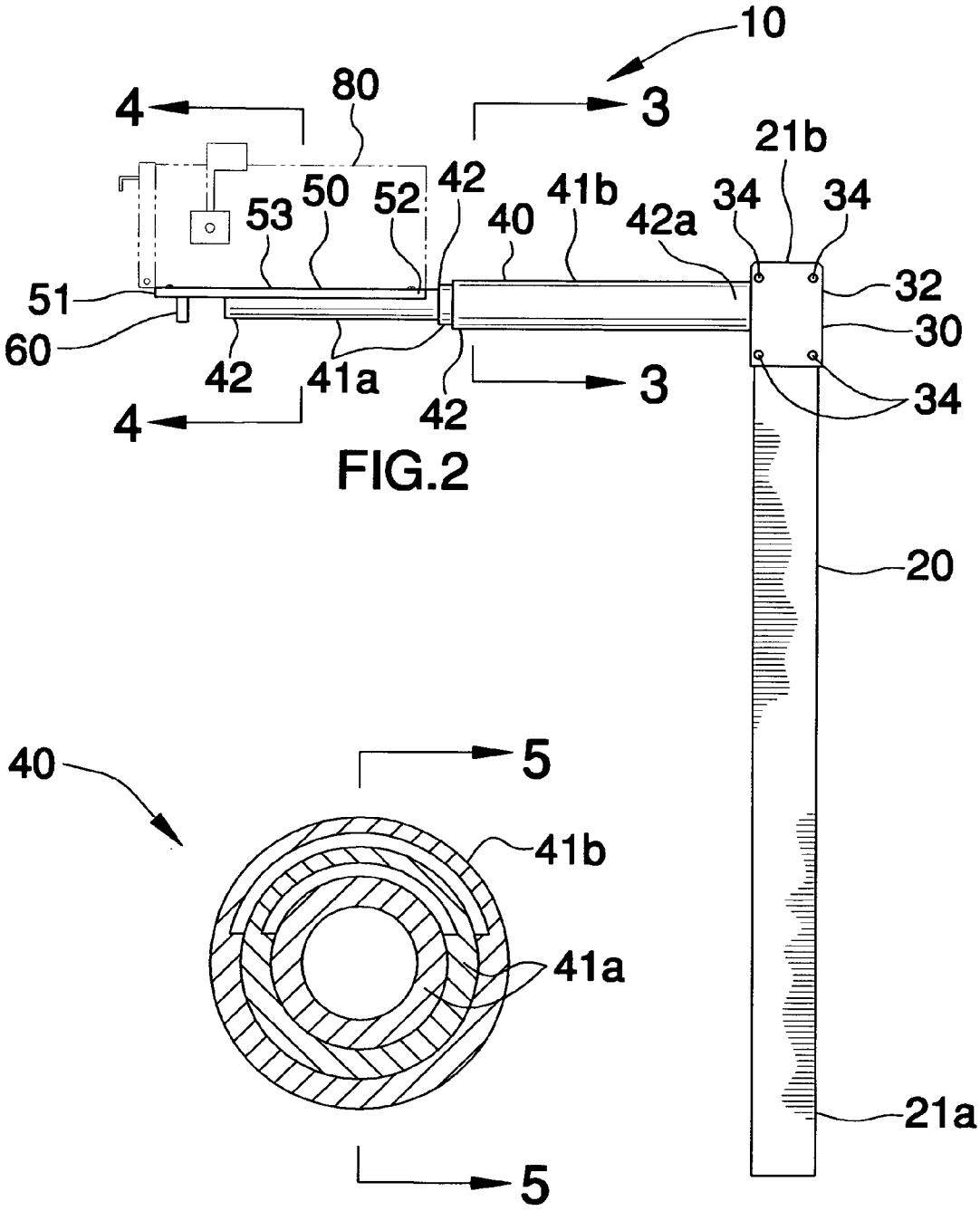
FIG. 2 is a side elevational view of the device shown in FIG. 1.
FIG. 3 is an enlarged cross-sectional view of the device shown in FIG. 2, taken along line 3—3.
Figure 4:
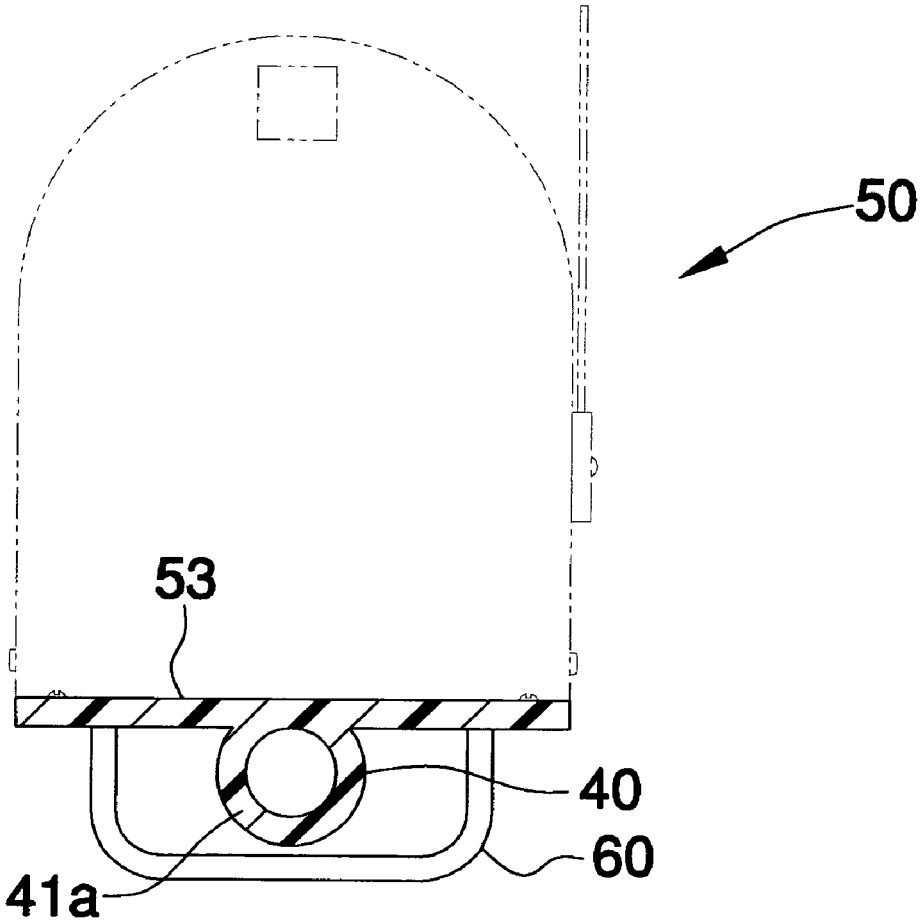
FIG. 4 is an enlarged cross-sectional view of the device shown in FIG. 2, taken along line 44.

As can be seen in FIGS. 1 and 2, the device 10 further includes a platform 50, having a substantially rectangular shape, which has front 51 and rear 52 portions secured to another one of the plurality of tubes 41*a* and is disposed forwardly thereof respectively. The platform 50 further has a substantially planar top surface 53 for securely maintaining a mailbox 80 thereon during operating conditions.

The present invention further includes a handle 60 that has a generally staple shape and is disposed adjacent to the front portion 51 of the platform 50. The handle 60 can be grasped by a user for conveniently moving the support member 40 between extended and retracted positions. Advantageously, the handle 60 extends downwardly from the platform 50 and terminates at a predetermined distance therebeneath so that a user can maintain contact with the platform 50 while contemporaneously retrieving mail from the mailbox 80.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A telescopic mailbox support device, said device comprising:

an elongated shaft having a vertically disposed longitudinal axis and opposed end portions disposed adjacent a ground surface and spaced upwardly therefrom at a predetermined height;

a bracket having a base portion and a plurality of sidewalls integral therewith and extending orthogonally therefrom, said bracket having a plurality of apertures spaced along said base portion and said plurality of sidewalls for receiving a plurality of corresponding fastening members therethrough so that said bracket can be secured to one said end portion of said elongated shaft;

a telescopic support member extending substantially orthogonal from said shaft and comprising a plurality of elongated tubes having a common centrally disposed longitudinal axis wherein select ones of said plurality of tubes are slidably engageable along a path substantially parallel to the axis for moving said support member between extended and retracted positions, said plurality of tubes each having opposed end portions, one said end portion of one said plurality of tubes being secured to said base of said bracket, said support member further having a plurality of stop members integral therewith for defining an axial distance along which said plurality of tubes can be extended and retracted respectively;

a platform having front and rear portions statically secured to another said plurality of tubes and being disposed forwardly thereof respectively, said platform further having a substantially planar top surface for securely maintaining a mailbox thereon; and a handle having a generally staple shape, said handle being disposed adjacent said front portion of said platform and being grasped by a user for moving said support member between extended and retracted positions.

2. The device of claim 1, wherein said bracket has a substantially U-shape.

3. The device of claim 1, wherein said platform has a substantially rectangular shape.

4. The device of claim 1, wherein said plurality of tubes have substantially cylindrical shapes.

5. The device of claim 1, wherein said one plurality of tubes is stationary and disposed at a fixed positioned adjacent said shaft.

6. The device of claim 1, wherein said handle extends downwardly from said platform and terminates at a predetermined distance therebeneath.

7. A telescopic mailbox support device, said device comprising:

an elongated shaft having a vertically disposed longitudinal axis and opposed end portions disposed adjacent a ground surface and spaced upwardly therefrom at a predetermined height;

a bracket having a base portion and a plurality of sidewalls integral therewith and extending orthogonally therefrom, said bracket having a plurality of apertures spaced along said base portion and said plurality of sidewalls for receiving a plurality of corresponding fastening members therethrough so that said bracket can be secured to one said end portion of said elongated shaft;

a telescopic support member extending substantially orthogonal from said shaft and comprising a plurality of elongated tubes having a common centrally disposed longitudinal axis wherein select ones of said plurality of tubes are slidably engageable along a path substantially parallel to the axis for moving said support member between extended and retracted positions, said plurality of tubes each having opposed end portions, one said end portion of one said plurality of tubes being secured to said base of said bracket, said support member further having a plurality of stop members integral therewith for defining an axial distance along which said plurality of tubes can be extended and retracted respectively;

a platform having front and rear portions statically secured to another said plurality of tubes and being disposed forwardly thereof respectively, said platform further having a substantially planar top surface for securely maintaining a mailbox thereon; and a handle having a generally staple shape defining a substantially U-shape, said handle being disposed adjacent said front portion of said platform and being grasped by a user for moving said support member between extended and retracted positions.

8. The device of claim 7, wherein said plurality of tubes have substantially cylindrical shapes.

9. The device of claim 7, wherein said one plurality of tubes is stationary and disposed at a fixed positioned adjacent said shaft.

10. The device of claim 7, wherein said handle extends downwardly from said platform and terminates at a predetermined distance therebeneath.

11. A telescopic mailbox support device, said device comprising:

an elongated shaft having a vertically disposed longitudinal axis and opposed end portions disposed adjacent a ground surface and spaced upwardly therefrom at a predetermined height;

a bracket having a base portion and a plurality of sidewalls integral therewith and extending orthogonally therefrom, said bracket having a plurality of apertures spaced along said base portion and said plurality of sidewalls for receiving a plurality of corresponding fastening members therethrough so that said bracket can be secured to one said end portion of said elongated shaft;

a telescopic support member extending substantially orthogonal from said shaft and comprising a plurality of elongated tubes having a common centrally disposed longitudinal axis wherein select ones of said plurality of tubes are slidably engageable along a path substantially parallel to the axis for moving said support member between extended and retracted positions, said plurality of tubes each having opposed end portions, one said end portion of one said plurality of tubes being secured to said base of said bracket, said support member further having a plurality of stop members integral therewith for defining an axial distance along which said plurality of tubes can extended and retracted respectively;

a platform having front and rear portions statically secured to another said plurality of tubes and being disposed forwardly thereof respectively, said platform further having a substantially rectangular shape and a substantially planar top surface for securely maintaining a mailbox thereon; and a handle having a generally staple shape defining a substantially U-shape, said handle being disposed adjacent said front portion of said platform and being grasped by a user for moving said support member between extended and retracted positions.

12. The device of claim 11, wherein said plurality of tubes have substantially cylindrical shapes.

13. The device of claim 11, wherein one said plurality of tubes is stationary and disposed at a fixed positioned adjacent said shaft.

14. The device of claim 11, wherein said handle extends downwardly from said platform and terminates at a predetermined distance therebeneath.

* * * * *